US006639993B2

(12) United States Patent
Kemmerer et al.

(10) Patent No.: US 6,639,993 B2
(45) Date of Patent: Oct. 28, 2003

(54) LOUDSPEAKER WITH LOW DISTORTION AND HIGH OUTPUT POWER

(75) Inventors: Jason Kemmerer, Thousand Oaks, CA (US); Eric Douglas Guarin, Alhambra, CA (US)

(73) Assignee: Alpine Electronics, Inc, Tokyo (JP)

( * ) Notice: Subject to any disclaimer, the term of this patent is extended or adjusted under 35 U.S.C. 154(b) by 0 days.

(21) Appl. No.: 10/036,777

(22) Filed: Dec. 29, 2001

(65) Prior Publication Data

US 2003/0123694 A1 Jul. 3, 2003

(51) Int. Cl.[7] ..... H04R 25/00
(52) U.S. Cl. ..... 381/397; 381/419
(58) Field of Search ..... 381/420, 397, 381/412, 430, 396, 419

(56) References Cited

U.S. PATENT DOCUMENTS 2,429,470 A * 10/1947 Knowles
2,858,377 A * 10/1958 Levy
4,313,040 A * 1/1982 Tsukamoto
4,933,975 A * 6/1990 Button
5,357,587 A 10/1994 Grodinsky et al.
5,550,332 A 8/1996 Sakamoto
6,208,743 B1 * 3/2001 Marten et al.
6,243,479 B1 6/2001 Proni

FOREIGN PATENT DOCUMENTS

JP U 6-2896 1/1994

* cited by examiner

*Primary Examiner*—Sinh Tran
(74) *Attorney, Agent, or Firm*—Muramatsu & Associates

(57) ABSTRACT

A loudspeaker having an improved acoustic performance achieved by low distortion and high output power. The loudspeaker includes a speaker frame, a diaphragm connected to the speaker frame, a voice coil which is formed on a voice coil bobbin and is connected to the diaphragm for vibrating the diaphragm, a permanent magnet having a central opening, and a pole piece disposed coaxially within the central opening of the permanent magnet to form an air gap into which the voice coil is disposed. The top area of the through hole of the pole piece is curved with an S-shape in cross section and an inner diameter of the through hole is increased toward the inner top thereof.

5 Claims, 5 Drawing Sheets

LOUDSPEAKER WITH LOW DISTORTION AND HIGH OUTPUT POWER

FIELD OF THE INVENTION

This invention relates to a loudspeaker for audio and video applications, and more particularly, to a loudspeaker having a specially structured pole piece for improving performance of the loudspeaker including low distortion and high output power.

BACKGROUND OF THE INVENTION

Loudspeakers, or speakers, are well known in the art and are commonly used in a variety of applications, such as in home theater stereo systems, car audio systems, indoor and outdoor concert halls, and the like. A loudspeaker typically includes an acoustic transducer comprised of an electromechanical device which converts an electrical signal into acoustical energy in the form of sound waves and an enclosure for directing the sound waves produced upon application of the electrical signal.

A loudspeaker comprises a coil of wire, typically referred to as a voice coil, which is suspended between a pole piece and a permanent magnet. In operation, an alternating current from an amplifier flows through the voice coil which produces a changing magnetic field around the voice coil. The changing magnetic field around the voice coil interacts with the magnetic field produced by the permanent magnet to produce reciprocal forces on the voice coil representing the current in the voice coil.

The voice coil is disposed within the loudspeaker so that it can oscillate in accordance with the reciprocal forces along the pole piece. The voice coil is attached to a cone shaped diaphragm which vibrates in response to the oscillation (reciprocal movement) of the voice coil. The vibration of the diaphragm produces acoustic energy in the air, i.e., a sound wave.

An example of structure in the conventional loudspeaker is shown in FIG. 1. The loudspeaker 11 includes a speaker cone 13 forming a diaphragm 17, a coil bobbin 25, and a dust cap 15. The diaphragm 17, the dust cap 15 and the coil bobbin 25 are attached to one another by, for example, an adhesive. Typically, the coil bobbin 25 is made of a high temperature resistant material such as glass fiber or aluminum around which an electrical winding or a voice coil 27 is attached such as by an adhesive. The voice coil 27 is connected to suitable leads (not shown) to receive an electrical input signal through the electrical terminals (not shown) noted above.

The diaphragm 17 is provided with an upper half roll 21 at its peripheral made of flexible material such as an urethane foam, butyl rubber and the like. The diaphragm 17 is connected to the speaker frame 19 at the upper half roll 21 by means of, for example, an adhesive. At about the middle of the speaker frame 19, the intersection of the diaphragm 17 and the coil bobbin 25 is connected to the speaker frame 19 through a spider (inner suspension) 23 made of a flexible material such as cotton with phenolic resin and the like. The upper half roll 21 and the spider 23 allow the flexible vertical movements of the diaphragm 17 as well as limit or damp the amplitudes (movable distance in an axial direction) of the diaphragm 17 when it is vibrated in response to the electrical input signal.

The loudspeaker 11 also comprises a magnetic assembly (magnetic circuit) formed of an air gap 41 and annular members including a pole piece 37, a permanent magnet 33, and an upper (top) plate 35. In this example, the pole piece 37 has a back plate 38 integrally formed at its bottom. The pole piece 37 has a central opening (air passage) 40 in the axial direction for dissipating heat generated by the voice coil 27.

The permanent magnet 33 is disposed between the upper plate 35 and the back plate 38 of the pole piece 37. The upper plate 35 and the pole piece 37 are constructed from a material capable of carrying magnetic flux, such as steel. Therefore, a magnetic path is created through the pole piece 37, the upper plate 35, the permanent magnet 33 and the back plate 38 through which the magnetic flux is running.

The air gap 41 is created between the pole piece 37 and the upper plate 35 in which the voice coil 27 and the coil bobbin 25 are inserted in the manner shown in FIG. 1. Thus, when the electrical input signal is applied to the voice coil 27, the current flowing in the voice coil 27 and the magnetic flux (flux density) interact with one another. This interaction produces a force on the voice coil 27 which is proportional to the product of the current and the flux density. This force activates the reciprocal movement of the voice coil 27 on the coil bobbin 25, which vibrates the diaphragm 17, thereby producing the sound waves.

In the audio sound reproduction involving such a loudspeaker, it is required that the loudspeaker is capable of producing a high output power with low distortion in the sound waves. It is known in the art that a loudspeaker is more nonlinear and generates more distortion in lower frequencies which require large displacement of the diaphragm. This invention is to improve the performance of the loudspeaker with use of a specifically designed pole piece in the magnetic assembly.

In the conventional technology, there is an example of magnetic assembly in which a cross sectional shape of the pole piece is inclined or curved to improve the speaker performance. This conventional example is disclosed in Japanese Utility Model Publication No. 6-2896, which is reproduced in FIGS. 2A and 2B. The magnetic assembly of FIGS. 2A and 2B is configured by a top plate 54, a pole piece 52 having a back plate 51, and a permanent magnet 53 sandwiched between the top plate 54 and the back plate 51. The pole piece 52 has a through hole 55 for air passage. An air gap 56 is created between the pole piece 52 and the top plate 54 for allowing reciprocal movements of the voice coil in the vertical direction of FIGS. 2A and 2B.

The inner wall of the pole piece 52 is inclined upwardly in a manner of straight line in FIG. 2A so that the inner diameter of the through hole 55 increases toward the top end. Similarly, the inner wall of the pole piece 52 is inclined upwardly in a manner of curved line in FIG. 2B so that the inner diameter of the through hole 55 increases toward the top end. According to the description in the publication No. 6-2896, such a conical shape of the upper portion of the pole piece 55 is effective in decreasing the resistance (fluid resistance of air) against the movement of the diaphragm even when the diameter of the through hole 55 is small. However, this conventional technology does not appear to function for reducing the magnetic distortion or increasing the output power of the loudspeaker.

SUMMARY OF THE INVENTION

It is, therefore, an object of the present invention to provide a loudspeaker having an improved acoustic performance which is achieved by low distortion and high output power.

It is another object of the present invention to provide a loudspeaker having an improved acoustic performance which is achieved by a unique structure of the pole piece having a curved inner surface.

The loudspeaker of the present invention has an improved acoustic performance achieved by low distortion and high output power. The loudspeaker includes a speaker frame, a diaphragm connected to the speaker frame, a voice coil which is formed on a voice coil bobbin and is connected to the diaphragm for vibrating the diaphragm, a permanent magnet having a central opening, and a pole piece disposed coaxially within the central opening of the permanent magnet to form an air gap into which the voice coil is disposed. The top area of the through hole of the pole piece is curved with an S-shape in cross section and an inner diameter of the through hole is increased toward the inner top thereof.

Preferably, an inner end of the pole piece is projected toward a direction of the diaphragm substantially higher than an upper surface of an upper plate. The S-shape of the top area of the pole piece is formed of a first curve which is projected in one transversal direction and a second curve which is projected in another transversal direction opposite to the first curve. Further, an outside surface of an upper end of the axial through hole is curved to promote smooth air flows between the inner area of the coil bobbin and the outside of the loud speaker.

According to the present invention, the loudspeaker is able to establish a force factor curve which is flat and symmetrical with respect to the axial movement of the voice coil. Thus, the magnetic assembly of the present invention provides an improved linearity in the sound reproduction. Further, the loudspeaker of the present invention is able to establish a flux density which is higher than the conventional example with respect to the axial movement of the voice coil. Thus, the loudspeaker of the present invention is able to produce a higher output power. Because of the unique structure of the pole piece, the loudspeaker of the present invention is able to achieve the improved acoustic performances noted above.

DETAILED DESCRIPTION OF THE INVENTION

Figure 1:
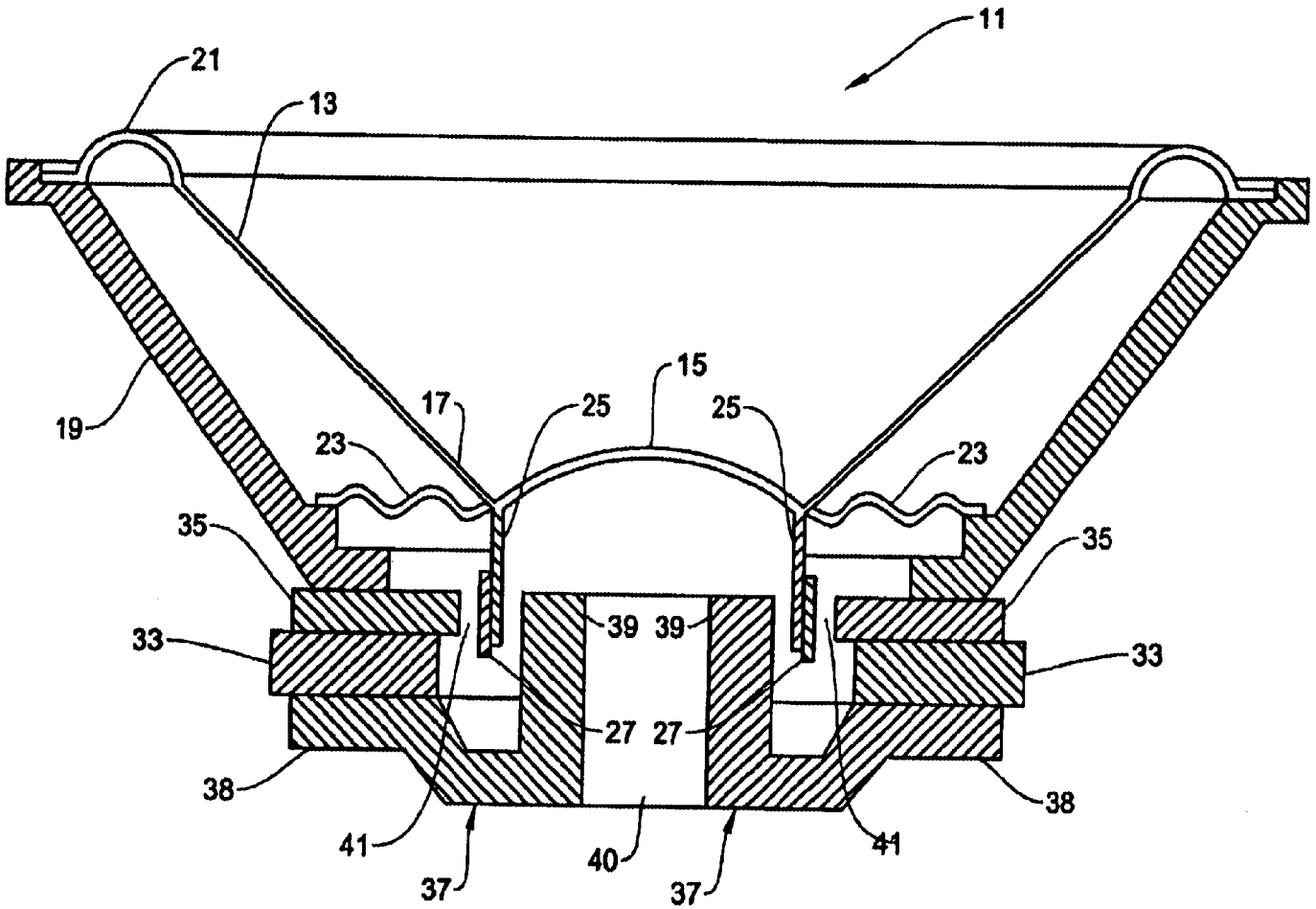
FIG. 1 (Prior Art)
FIG. 1 is a cross sectional view showing an example of structure of a loudspeaker including a magnetic assembly having a conventional pole piece.

Referring now to the drawings, there is illustrated a loudspeaker, constructed in accordance with the present invention and generally designated by a reference number 60 which may be disposed in a speaker cabinet or on an automobile inner wall. Although not shown, electrical terminals are provided to the loudspeaker to supply an electrical input signal to a voice coil of the loudspeaker whereby the electrical energy is converted into acoustical energy in the form of sound waves.

Figure 3:
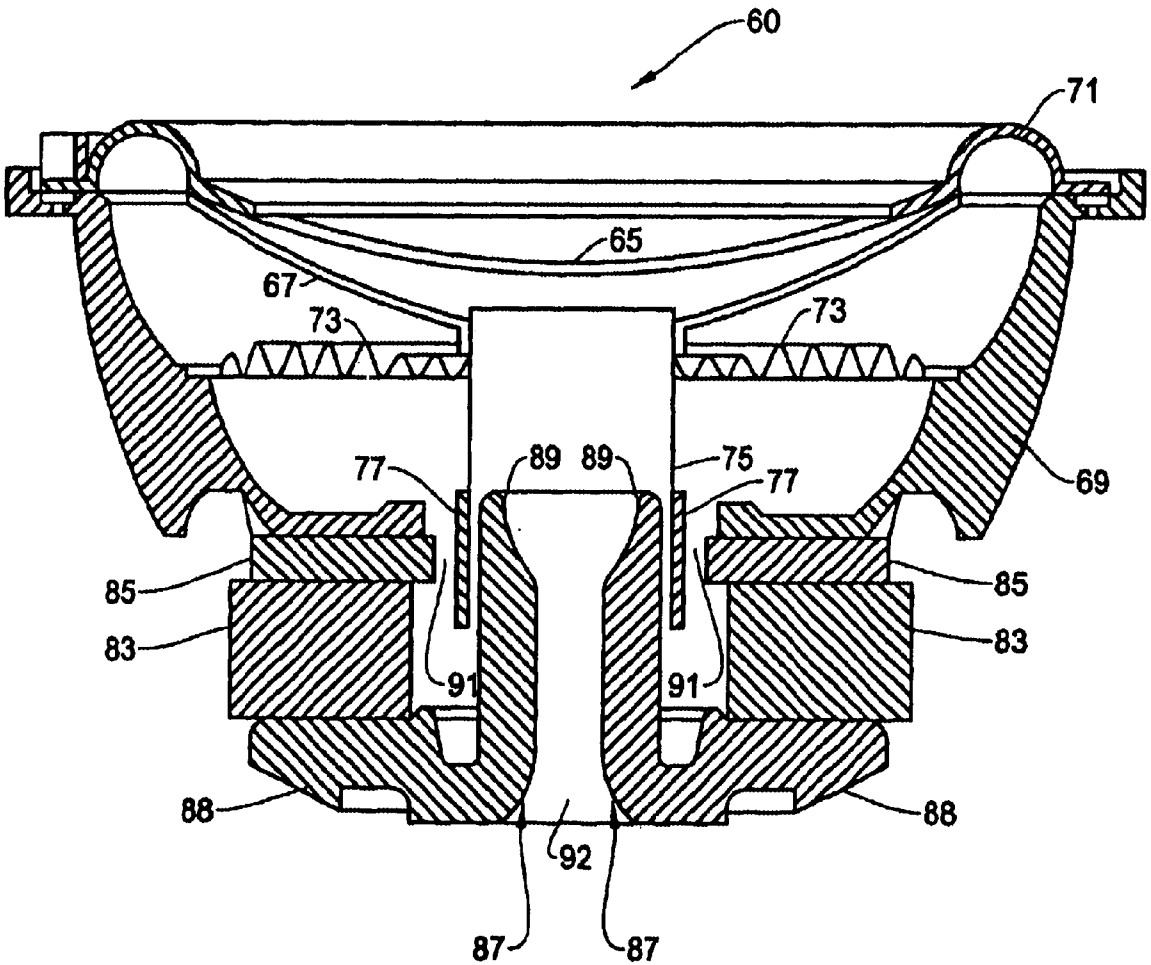
FIG. 3 is a cross sectional view showing an example of structure of a loudspeaker including a magnetic assembly which has a specially made pole piece of the present invention.

With reference to FIG. 3, the loudspeaker 60 includes a speaker cone or a diaphragm 67, a coil bobbin 75, and a dust cap 65. The diaphragm 67, the dust cap 65 and the coil bobbin 75 are attached to one another by, for example, an adhesive. Typically, the coil bobbin 75 is made of a high temperature resistant material such as glass fiber or aluminum around which an electrical winding or a voice coil 77 is attached such as by an adhesive. The voice coil 77 is connected to suitable leads (not shown) to receive an electrical input signal through the electrical terminals (not shown) noted above.

The diaphragm 67 is provided with an upper half roll 71 at its peripheral made of flexible material such as an urethane foam, butyl rubber and the like. The diaphragm 67 is connected to the speaker frame 69 at the upper half roll 71 by means of, for example, an adhesive. The speaker frame 69 has a plurality of radially and downwardly extending frame members (not shown) and is integrally constructed of a stiff antivibrational material, such as aluminum.

At about the middle of the speaker frame 69, the intersection of the diaphragm 67 and the coil bobbin 75 is connected to the speaker frame 69 through a spider (inner suspension) 73 made of a flexible material such as cotton with phenolic resin and the like. The upper half roll 71 and the spider 73 allow the flexible vertical (axial) movements of the diaphragm 67 as well as limit or damp the amplitudes (movable distance in an axial direction) of the diaphragm 67 when it is vibrated in response to the electrical input signal.

The loudspeaker 60 also comprises a magnetic assembly (magnetic circuit) formed of an air gap 91 and annular members including a pole piece 87, a permanent magnet 83, and an upper (top) plate 85. The pole piece 87 has a back plate 88 integrally formed at the bottom of the magnetic assembly. The pole piece 87 has a central opening (axial through hole) 92 in the axial direction having a curved inner wall 89 at its top. The opening (though hole) 92 establishes an air passage between the inside and outside of the loudspeaker 60 for heat dissipation (cooling). The vibration of the diaphragm 67 produces air flows through the opening to intake cool air and exhaust heated air between the inside and outside of the loudspeaker.

The permanent magnet 83 is disposed between the upper plate 85 and the back plate 88 of the pole piece 87. The upper plate 85 and the pole piece 87 are constructed from a material capable of carrying magnetic flux, such as steel. Therefore, a magnetic path is created through the pole piece 87, the upper plate 85, the permanent magnet 83 and the back plate 88 through which the magnetic flux is running.

The air gap 91 is created between the pole piece 87 and the upper plate 85 in which the voice coil 77 and the coil bobbin 75 are inserted in the manner shown in FIG. 3. Thus, when the electrical input signal is applied to the voice coil 77, the current flowing in the voice coil 77 and the magnetic flux (flux density) interact with one another. This interaction produces a force on the voice coil 77 which is proportional to the product of the current and the flux density. This force activates the reciprocal movement of the voice coil 77 on the coil bobbin 75, which vibrates the diaphragm 67, thereby producing the sound waves.

In accordance with the present invention, the pole piece 87 has a unique shape in cross section at its top 89 in the central opening 92 as shown in FIG. 3. This specific structure of the pole piece 87 contributes to the reduction of the distortion, i.e., improved linearity of the magnetic field at the gap 91 with respect to the reciprocal movement of the voice coil 77. The pole piece 87 is so curved at the top 89 that an inner surface thereof has an S-shape in cross section while increasing the inner diameter (opening 92) toward the top end (inner end). The top end and the bottom end of the central opening (axial through hole) 92 of the pole piece 87 are also rounded (curved) as shown in FIG. 3 for promoting smooth air passage.

Figure 2A:
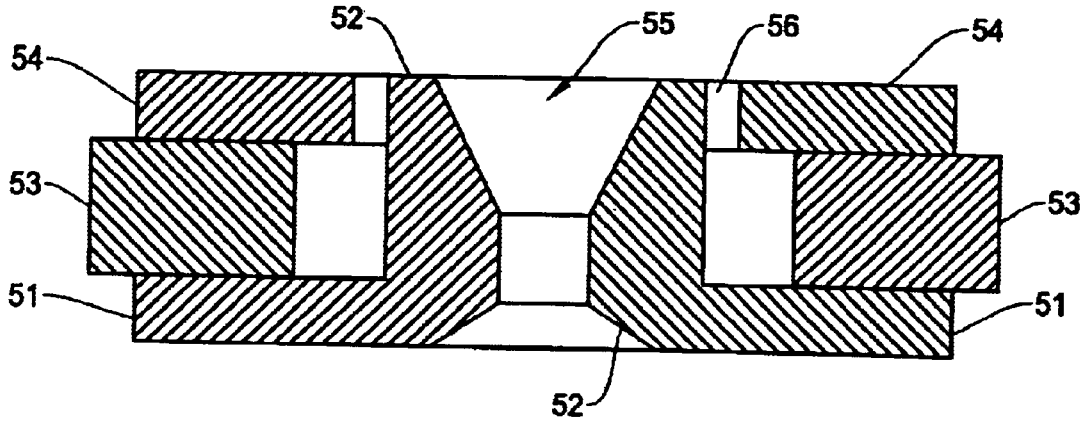
FIG. 2A (Prior Art)
FIG. 2A is a cross sectional view showing an example of a conventional magnetic assembly in a loudspeaker and FIG. 2B is a cross sectional view showing another example of a conventional magnetic assembly.
Figure 2B:
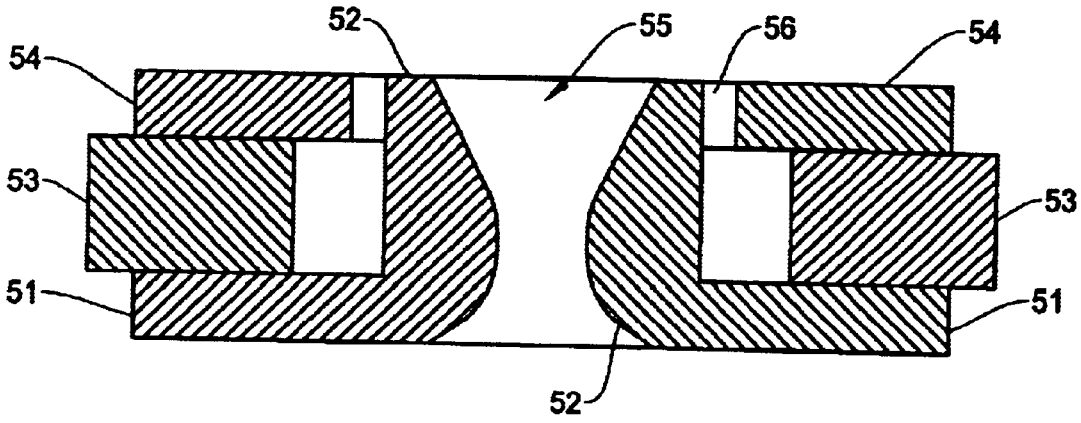
FIG. 2B (Prior Art)
Figure 5A:
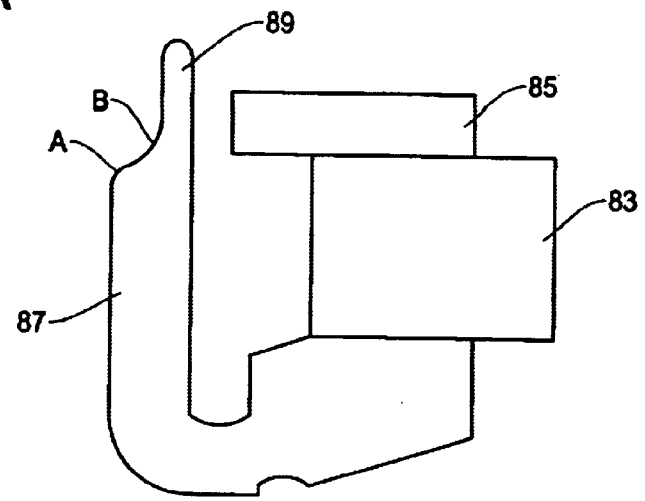
FIG. 5A is a schematic diagram showing a cross sectional structure of the magnetic assembly having the pole piece of the present invention and FIG. 5B is a graph showing the relationship between the axial displacement of the voice coil and the flux density or force factor in the magnetic assembly of FIG. 5A.

It should be noted that the curve of the top 89 of the pole piece 87 is not an inclined straight line shape or a simple circular curve such as shown in FIGS. 2A and 2B, respectively. As noted above, the curve at the top 89 is S-shaped in cross section in such a way that the rounds (curves) of the surface are directed to opposite directions. For example, as shown in FIG. 5A, a curve A is slightly projected in the left direction while a curve B is slightly projected in the right direction of the drawing, thereby forming the S-shaped curve.

In FIG. 3, the top end of the pole piece 87 is positioned substantially higher than the upper surface of the upper (top) plate 85. This relationship of the present invention is different from those shown in FIGS. 1 or 2A and 2B where the top end of the pole piece is about the same vertical (axial) position as the upper surface of the upper plate. One of advantages in forming the top end of the pole piece higher than the upper plate 85 is that the heat dissipated by the voice coil 77 is more efficiently transferred to the overall speaker system through the pole piece 87 and exhausted through the central opening 92.

In the loudspeaker of the present invention, because of the unique structure of the pole piece 87, the magnetic flux from the top 89 of the pole piece 87 to the upper plate 85 is uniformly distributed in cross section of the gap 91. This is because the S-shaped cross section of the top 89 of the pole piece guides the magnetic flux therein without causing any abrupt change in the direction of the flux. Further because of the smooth shape of the pole piece 87, the magnetic flux density throughout the pole piece is more uniform than the conventional pole piece, suppressing any pinching point (hot point) of the flux.

Since the magnetic flux distribution is well balanced at the gap 91, the loudspeaker 60 is able to achieve an improved linearity at the reciprocal movement of the voice coil 77. In other words, the voice coil 77 receives a flat and symmetrical force during the vertical (axial) movement of FIG. 3 in the gap 91, resulting in the reduction of distortion. In addition, because the pole piece 87 has almost no pinching point of the magnetic flux, eddy current caused by the pinching point of the flux is also reduced, resulting in further reduction of the distortion.

Further, the magnetic flux from the top 89 of the pole piece 87 enters the top plate 85 at the right angle with respect to an end surface of the top plate 85. This is effective in maximizing the output of the loudspeaker 60 since the magnetic flux reacts with the voice coil 77 efficiently and thus produces a higher power on the voice coil 77. Thus, the pole piece 87 in the loudspeaker 60 of the present invention is capable of decreasing the distortion while increasing the output power.

Figure 4A:
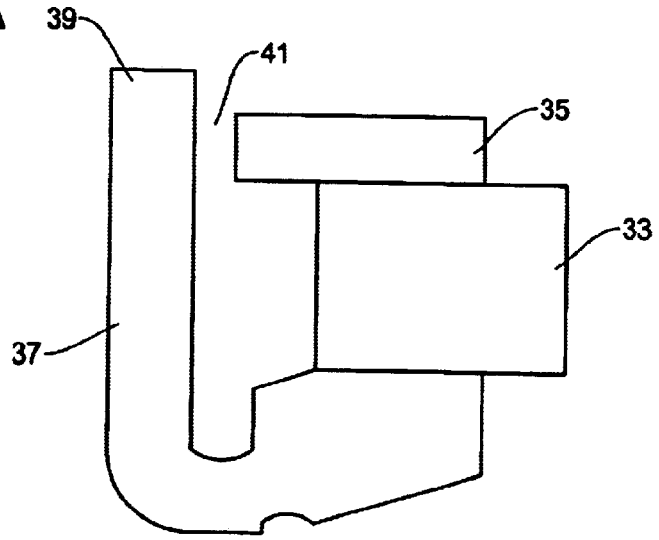
FIG. 4A is a schematic diagram showing a cross sectional structure of the magnetic assembly having the conventional pole piece and FIG. 4B is a graph showing the relationship between the axial displacement of the voice coil and the flux density or force factor in the magnetic assembly of FIG. 4A.
Figure 4B:
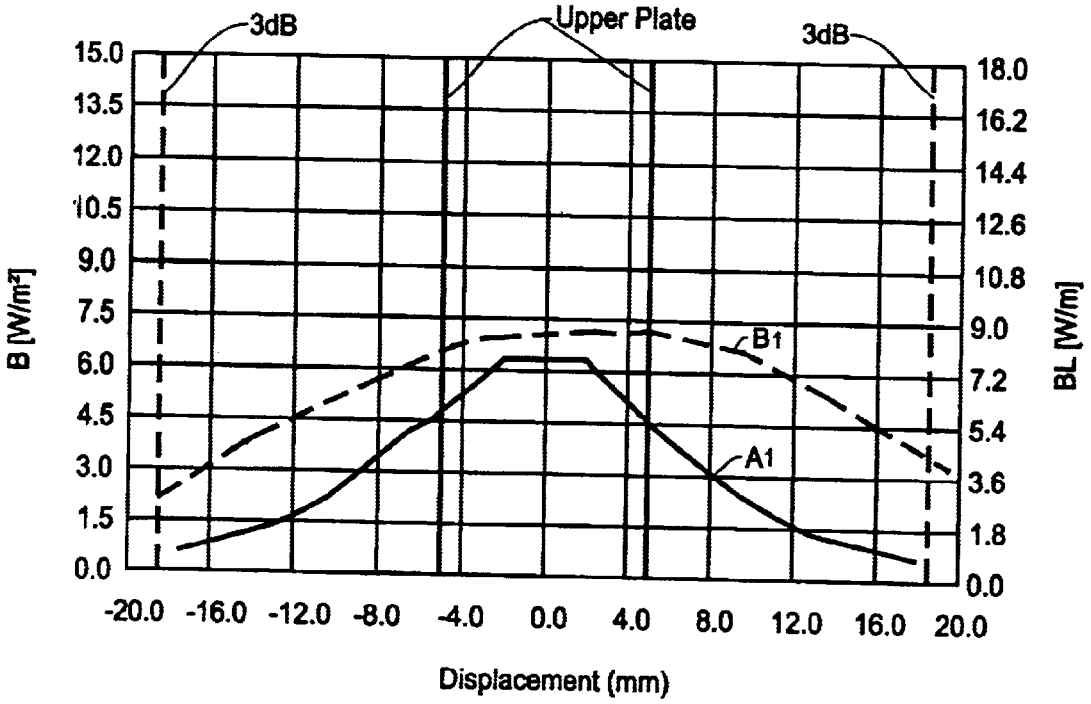
Figure 5B:
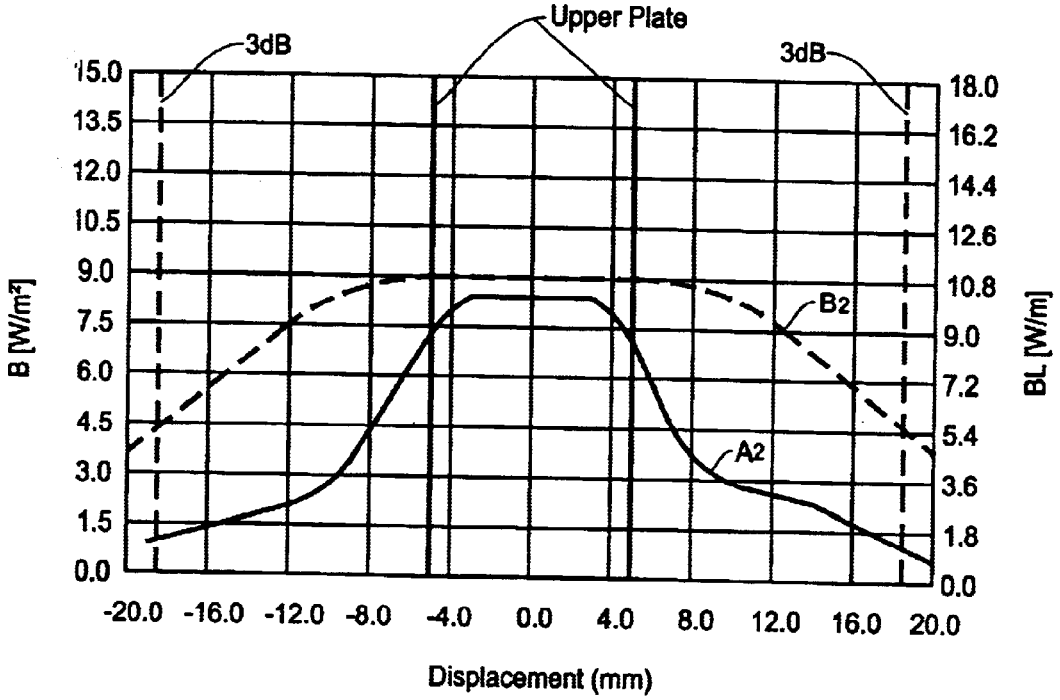

The effect of the present invention is described in more detail with reference to FIGS. 4 and 5. FIG. 4A is a schematic diagram showing a cross sectional structure of the magnetic assembly having a conventional pole piece and FIG. 4B is a graph showing a relationship between the displacement of the voice coil and the flux density or force factor in the magnetic assembly of FIG. 4A. FIG. 5A is a schematic diagram showing a cross sectional structure of the magnetic assembly having a pole piece of the present invention and FIG. 5B is a graph showing a relationship between the displacement of the voice coil and the flux density or force factor in the magnetic assembly of FIG. 5A. FIG. 4A and FIG. 5A show only one side of the cross sectional view of the magnetic assembly.

In the example of FIGS. 4A and 4B, the conventional pole piece 37 has a straight rectangular shape at the upper part thereof similar to that used in the loudspeaker 11 of FIG. 1. The voice coil moves up and down in the gap 41 formed between the pole piece 37 and the upper (top) plate 35 of FIG. 4A. In this example, the upper plate 35 has a thickness of 10 mm.

In the graph of FIG. 4B, the solid line Al indicates magnetic flux density crossing the voice coil with respect to the vertical movement (displacement in the axial direction) of the voice coil in the gap 41. Two vertical solid lines indicate the thickness of the upper plate 35 which is 10 mm in this example. The broken line B1 indicates a force factor acting on the voice coil with respect to the vertical (axial) movement of the voice coil. Two vertical broken lines indicate 3 dB down points of the force factor, i.e, approximately 70% of the highest force factor.

The horizontal scale represents the axial displacement (vertical position) of the voice coil with respect to the gap 41. The numeral "0.0" indicates a center of the gap, i.e., the center of the thickness of the upper plate 35 where the left direction (negative sign) from "0.0" indicates the downward movement of the voice coil while the right direction from "0.0" indicates the upward movement of the voice coil. The vertical scale in the left indicates the flux density and the vertical scale in the right indicates the force factor.

In FIG. 5A and 5B, the pole piece 87 of the present invention has the S-shape curve at the top 89 in cross section. The inner diameter of the pole piece 87 decreases toward the top end. Further, as noted above, the S-shape includes the curve A which is projected in the left direction and the curve B which is projected in the right direction of FIG. 5A. Preferably, each of the curve A and the curve B is a compound curve, i.e., the radius thereof is not constant. Further, preferably, the very top of the pole piece has also two curves where the left side curve is nearly sharp and the right side curve is moderate.

Similar to FIG. 4B, in the graph of FIG. 5B, the solid line A2 indicates the magnetic flux density crossing the voice coil with respect to the vertical movement (displacement in the axial direction) of the voice coil in the gap 91. Two vertical solid lines indicate the thickness of the upper plate 85 which is 10 mm. The broken line B2 indicates the force factor acting on the voice coil with respect to the vertical (axial) movement of the voice coil. Two vertical broken lines indicate 3 dB down points of the force factor, i.e, approximately 70% of the highest force factor, which is commonly known as a linear X max. The horizontal and vertical scales are the same as those of FIG. 4B.

In the graph of FIG. 4B, the highest magnetic flux density (solid line Al) is about 6.9 [$W/m^2$] and the highest force factor (broken line B1) is about 8.7 [W/m]. The force factor curve is slightly inclined toward the right and curved within the thickness of the upper plate. In the graph of FIG. 5B, the highest magnetic flux density (solid line A2) is about 8.2 [W/m$^2$] and the highest force factor (broken line B2) is about 10 [W/m] and is substantially flat within the thickness of the upper plate.

As shown in FIG. 5B, the force factor has an absolute value higher than the conventional example of FIG. 4B. The force factor curve is flat and symmetrical especially within the thickness of the upper plate. Thus, the magnetic assembly of the present invention provides an improved linearity, i.e, low distortion, with respect to the reciprocal movement of the voice coil. Further, as shown in FIG. 5B, the flux density curve shows an absolute value higher than the conventional example of FIG. 4B. Thus, the magnetic assembly of the present invention is able to produce a higher output power with respect to the reciprocal movement of the voice coil than that of FIG. 4B. As has been foregoing, the loudspeaker of the present invention achieves the improved acoustic performances, i.e., the low distortion and the high output power.

Although only a preferred embodiment is specifically illustrated and described herein, it will be appreciated that many modifications and variations of the present invention are possible in light of the above teachings and within the purview of the appended claims without departing the spirit and intended scope of the invention.

What is claimed is:

1. A loudspeaker comprising:

a speaker frame;

a diaphragm connected to said speaker frame in a manner capable of vibration;

a voice coil which is formed on a voice coil bobbin and is connected to said diaphragm for vibrating the diaphragm;

a permanent magnet having a central opening;

an upper plate having a central opening and provided on the permanent magnet; and a pole piece disposed coaxially within the central opening of said permanent magnet to form an air gap between said pole piece and said upper plate into which said voice coil is disposed, the pole piece having an axial through hole at its center for establishing an air passage between inside and outside of the loudspeaker;

wherein a top area of the through hole of the pole piece is curved with an S-shape in cross section and an inner diameter of the through hole is increased toward the inner top thereof, and wherein an outside surface of an upper end of said axial through hole is curved to promote smooth air flows between an inner area of said voice coil bobbin and the outside of said loudspeaker.

2. A loudspeaker as defined in claim 1, wherein an inner end of said pole piece is projected toward the diaphragm substantially higher than an upper surface of the upper plate.

3. A loudspeaker as defined in claim 1, wherein said S-shape of said top area of said pole piece is formed of a first curve which is projected in one transversal direction and a second curve which is projected in another transversal direction opposite to the first curve.

4. A loudspeaker as defined in claim 1, said axial through hole of said pole piece establishes said air passage between an inner area of said voice coil bobbin and the outside of said loudspeaker wherein the vibration of said diaphragm produces air flows through said axial through hole to intake cool air and exhaust heated air between the inside and outside of the loudspeaker.

5. A loudspeaker as defined in claim 1, wherein said pole piece transversely extends at its lower end to form a back plate, and wherein said upper plate and said back plate sandwich said permanent magnet therebetween, thereby forming a magnetic circuit where magnetic flux runs through said pole piece, upper plate and permanent magnet.

* * * * *